US010806306B2

(12) United States Patent
Morand

(10) Patent No.: US 10,806,306 B2
(45) **Date of Patent: *Oct. 20, 2020**

(54) ROLLED PRODUCT DISPENSER

(71) Applicant: CASCADES CANADA ULC, Montrëal (CA)

(72) Inventor: Michel Morand, Verdun (CA)

(73) Assignee: CASCADES CANADA ULC, Montreal (CA)

( * ) Notice: Subject to any disclaimer, the term of this patent is extended or adjusted under 35 U.S.C. 154(b) by 49 days.

This patent is subject to a terminal disclaimer.

(21) Appl. No.: 16/382,458

(22) Filed: Apr. 12, 2019

(65) Prior Publication Data

US 2019/0231149 A1 Aug. 1, 2019

Related U.S. Application Data

(63) Continuation of application No. 15/029,569, filed as application No. PCT/CA2014/050995 on Oct. 16, 2014, now Pat. No. 10,292,542.
(Continued)

(51) Int. Cl.
*B65H 20/02* (2006.01)
*B65H 16/00* (2006.01)
(Continued)

(52) U.S. Cl.
CPC ..... *A47K 10/36* (2013.01); *A47K 10/3643* (2013.01); *A47K 10/38* (2013.01); *B65H 16/005* (2013.01); *B65H 20/02* (2013.01); *A47K 2010/3675* (2013.01); *A47K 2010/3681* (2013.01); *A47K 2010/3863* (2013.01); *B65H 2301/443246* (2013.01); *B65H 2402/542* (2013.01); *B65H 2701/1924* (2013.01)

(58) Field of Classification Search
CPC ..... A47K 10/36; A47K 10/38; A47K 2010/3675; A47K 2010/3681; A47K 2010/3863; B65H 16/005; B65H 20/02; B65H 23/16; B65H 2701/1924; B65H 2301/443246; B65H 2402/542
See application file for complete search history.

(56) References Cited

U.S. PATENT DOCUMENTS 2,224,572 A 12/1940 Harvey
2,322,531 A 6/1943 Maltby et al.
(Continued)

FOREIGN PATENT DOCUMENTS

CA 2666201 A1 5/2008
JP H11246093 A 9/1999
JP 2002-274719 A 9/2002

OTHER PUBLICATIONS

International Search Report and Written Opinion for International Application No. PCT/CA2014/050995, dated Dec. 19, 2014.

*Primary Examiner* — William E Dondero
(74) *Attorney, Agent, or Firm* — Marshall, Gerstein & Borun LLP

(57) ABSTRACT

A rolled product dispenser for dispensing a web of rolled product, comprising: a housing; and a dispensing assembly at least partially housed in the housing and interacting with the web of rolled product and including a dispensing roller having a rotation center and a peripheral wall with an upper section. The dispensing assembly can comprise an upper tensioning assembly and/or a lower tensioning assembly and/or a variable tension return assembly.

18 Claims, 7 Drawing Sheets

Related U.S. Application Data

(60) Provisional application No. 61/891,652, filed on Oct. 16, 2013.

(51) Int. Cl.
*A47K 10/38* (2006.01)
*A47K 10/36* (2006.01)

(56) References Cited

U.S. PATENT DOCUMENTS

| | | | |
|---|---|---|---|
| 4,307,638 | A | 12/1981 | DeLuca et al. |
| 4,807,823 | A | 2/1989 | Wyant |
| 4,846,412 | A | 7/1989 | Morand |
| 5,009,313 | A | 4/1991 | Morand |
| 5,100,075 | A | 3/1992 | Morand |
| 5,161,723 | A | 11/1992 | Wirtz-Odenthal |
| 5,318,210 | A | 6/1994 | Morand |
| 5,335,811 | A | 8/1994 | Morand |
| 5,441,189 | A | 8/1995 | Formon et al. |
| 5,833,169 | A | 11/1998 | Morand |
| 5,937,718 | A | 8/1999 | Granger |
| 6,196,102 | B1 | 3/2001 | Granger |
| 6,412,678 | B2 | 7/2002 | Gracyalny et al. |
| 6,446,901 | B1 | 9/2002 | Haen et al. |
| 6,450,076 | B1 | 9/2002 | Granger |
| 7,040,566 | B1 | 5/2006 | Rodrian et al. |
| 7,537,180 | B2 | 5/2009 | Morand |
| 7,984,871 | B2 | 7/2011 | Nagata |
| 8,146,471 | B2 | 4/2012 | Hansen et al. |
| 2005/0011987 | A1 | 1/2005 | Lemaire et al. |
| 2008/0048064 | A1 | 2/2008 | Lemaire et al. |
| 2014/0054410 | A1 | 2/2014 | Achton |
| 2016/0262581 | A1 | 9/2016 | Morand |

ROLLED PRODUCT DISPENSER

CROSS REFERENCE TO RELATED APPLICATION

This application is a continuation of U.S. patent application Ser. No. 15/029,569, filed Apr. 14, 2016, which was a US national phase of international application number PCT/CA2014/050995, having an international filing date of Oct. 16, 2014, which claimed the benefit of the filing date, under 35 U.S.C. § 119(e), of U.S. provisional patent application No. 61/891,652 which was filed on Oct. 16, 2013. The entirety of the aforementioned applications are hereby incorporated by reference.

FIELD OF THE INVENTION

The present invention relates to the field of dispensers. More particularly, it relates to a dispenser for rolled products such as rolled paper products.

BACKGROUND

Several types and models of rolled product dispensers are currently available on the market, especially for dispensing rolled paper, including, without being limitative, dispensers for hand paper towels similar to the ones found in public bathrooms. These dispensers are configured for dispensing paper from a web of the rolled product to a user and for cutting the web of rolled product once a desired length has been dispensed. The desired length can either be predetermined or can be controlled by the user of the dispenser.

One of the drawbacks of known rolled product dispensers is that, in many cases, when a user pulls sharply on the web of rolled product protruding outwardly from a housing of the dispenser, the rolled product is caused to overspin inside the housing, i.e. the roll of rolled product continues to rotate after the user has stopped pulling on the web of rolled product. This is undesirable as it creates a section of loose paper product within the dispenser.

Moreover, another drawback of known rolled product dispensers is that the length of the paper product extending outwardly of the housing following a pull, is often inappropriate, i.e. longer than required or desired, which can, for example, lead to bacterial contamination and/or product waste.

In view of the above, there is a need for an improved rolled product dispenser, which by virtue of its design and components, would be able to overcome or at least minimize some of the above-discussed prior art concerns.

SUMMARY OF THE INVENTION

According to a general aspect, there is provided a rolled product dispenser for dispensing a web of rolled product. The rolled product dispenser comprises: a housing; and a dispensing assembly at least partially housed in the housing and interacting with the web of rolled product. The dispensing assembly comprises: a dispensing roller having a rotation center and a peripheral wall with an upper section; and an upper tensioning assembly including an upper tensioning member slidably mounted to the housing and slidable along an upper tensioning path, the upper tensioning assembly urging the web of rolled product against the upper section of the peripheral wall of the dispensing roller when engaged with the dispensing assembly, the upper tensioning path conforming to a section of the peripheral wall of the dispensing roller while being spaced apart therefrom.

In an embodiment, the housing comprises at least two spaced-apart supporting members supporting the dispensing roller on opposed ends thereof with each one of the supporting members comprising an upper groove defined therein and defining the upper tensioning path and wherein the upper tensioning member comprises an upper tensioning roller slidably engaged in the upper grooves of the supporting members and being slidable along the upper tensioning path. The upper grooves can have a lower and forward end and wherein the upper tensioning assembly can further comprise a biasing member connected to the upper tensioning roller and biasing the upper tensioning member towards the lower and forward end of the upper grooves.

In an embodiment, the peripheral wall of the dispensing roller also has a lower section and wherein the dispensing assembly further comprises a lower tensioning assembly including a lower tensioning member mounted to the housing and urging the web of paper against the lower section of the dispensing roller when engaged with the dispensing assembly. The upper tensioning assembly and the lower tensioning assembly can be configurable between a full tension configuration and a lower tension configuration, the upper tensioning assembly and the lower tensioning assembly being configured for the web of rolled product to cover more than about 60% of the peripheral wall of the dispensing roller when configured in the full tension configuration. The upper tensioning assembly and the lower tensioning assembly can be configured for the web of rolled product to cover between about 60% and about 75% of the peripheral wall of the dispensing roller when configured in the full tension configuration. The dispensing assembly can further comprise at least one finger stripper connected to the upper tensioning assembly and the lower tensioning assembly and extending rearwardly of the peripheral wall of the dispensing roller, the at least one finger stripper defining a web path with the peripheral wall of the dispensing roller, the web of the rolled product at least partially contouring the upper tensioning member and the lower tensioning member and extending in the web path when engaged with the dispensing assembly. The housing can comprise at least two spaced-apart supporting members supporting the dispensing roller on opposed ends thereof with each one of the supporting members comprising a lower groove defined therein and defining a lower tensioning path and wherein the lower tensioning member can comprise a lower tensioning roller slidably engaged in the lower grooves of the supporting members and being slidable along the lower tensioning path. The lower grooves can extend substantially tangentially to the peripheral wall of the dispensing roller. The lower grooves can have an upper end and wherein the lower tensioning assembly can further comprise a biasing member connected to the lower tensioning roller and biasing the lower tensioning member towards the upper end of the lower grooves.

In an embodiment, the peripheral wall of the dispensing roller also has a lower section and wherein the dispensing assembly further comprises a lower tensioning assembly including a lower tensioning member mounted to the housing and urging the web of paper against the lower section of the dispensing roller when engaged with the dispensing assembly. Each one of the supporting members can comprise a lower groove defined therein and defining a lower tensioning path and wherein the lower tensioning member can comprise a lower tensioning roller slidably engaged in the lower grooves of the supporting members and being slidable along the lower tensioning path. The dispensing assembly can further comprise at least one finger stripper connected to the upper tensioning member and the lower tensioning member and extending rearwardly of the peripheral wall of the dispensing roller, the at least one finger stripper defining a web path with the peripheral wall of the dispensing roller, the web of the rolled product at least partially contouring the upper tensioning member and the lower tensioning member and extending in the web path when engaged with the dispensing assembly. The lower grooves can extend substantially tangentially to the peripheral wall of the dispensing roller. The upper grooves can have a lower and forward end and the lower groove can have an upper end and wherein the lower and upper tensioning assemblies further comprises a biasing member having a first end connected to the upper tensioning assembly and a second end connected to the lower tensioning assembly and biasing the upper tensioning roller towards the lower ends of the upper grooves and the lower tensioning roller towards the upper ends of the lower grooves.

In an embodiment, the rolled product dispenser can further comprise a variable tension return assembly comprising: at least one eccentric attachment point spaced apart from the rotation center of the dispensing roller; at least one anchor provided on the housing; and a dispensing roller biasing member extending along a path and connecting one of the at least one eccentric attachment point and one of the at least one anchor, the dispensing roller biasing member being configurable in at least two extension states by modifying at least one of the at least one eccentric attachment point, the at least one anchor, and the path of the dispensing roller biasing member. The variable tension return assembly can comprise at least one of a plurality of eccentric attachment points positioned at different distances from one of the at least one anchor and a plurality of anchors positioned at different distances from one of the at least one eccentric attachment point. The variable tension return assembly can further comprise at least one tension adjusting pin mounted to the housing and engageable with the dispensing roller biasing member between the at least one eccentric attachment point and the at least one anchor, each of the at least one tension adjusting pin being positioned to vary an angular position of the dispensing roller upon engagement with the dispensing roller biasing member.

According to another general aspect, there is provided a rolled product dispenser for dispensing a web of rolled product. The rolled product dispenser comprising: a housing; and a dispensing assembly at least partially housed in the housing and interacting with the web of rolled product. The dispensing assembly comprises: a dispensing roller having a rotation center and a peripheral wall with a lower section; and a lower tensioning assembly including a lower tensioning member mounted to the housing and urging the web of paper against the lower section of the peripheral wall of the dispensing roller when engaged with the dispensing assembly.

In an embodiment, the housing comprises at least two spaced-apart supporting members supporting the dispensing roller on opposed ends thereof with each one of the supporting members comprising a lower groove defined therein and defining a lower tensioning path and wherein the lower tensioning member comprises a lower tensioning roller slidably engaged in the lower grooves of the supporting members and being slidable along the lower tensioning path. The lower grooves can extend substantially tangentially to the peripheral wall of the dispensing roller. The lower grooves can have an upper end and wherein the lower tensioning assembly can further comprise a biasing member connected to the lower tensioning roller and biasing the lower tensioning roller towards the upper ends of the lower grooves.

In an embodiment, the rolled product dispenser can further comprise a variable tension return assembly comprising: at least one eccentric attachment point spaced apart from the rotation center of the dispensing roller; at least one anchor provided on the housing; and a dispensing roller biasing member extending along a path and connecting one of the at least one eccentric attachment point and one of the at least one anchor, the dispensing roller biasing member being configurable in at least two extension states by modifying at least one of the at least one eccentric attachment point, the at least one anchor, and the path of the dispensing roller biasing member. The variable tension return assembly can comprise at least one of a plurality of eccentric attachment points positioned at different distances from one of the at least one anchor and a plurality of anchors positioned at different distances from one of the at least one eccentric attachment point. The variable tension return assembly can further comprise at least one tension adjusting pin mounted to the housing and engageable with the dispensing roller biasing member between the at least one eccentric attachment point and the at least one anchor, each of the at least one tension adjusting pin being positioned to vary an angular position of the dispensing roller upon engagement with the dispensing roller biasing member.

According to still another general aspect, there is provided rolled product dispenser for dispensing a web of rolled product. The rolled product dispenser comprising: a housing and a dispensing assembly at least partially housed in the housing and interacting with the web of rolled product. The dispensing assembly comprises: a dispensing roller having a rotation center and a peripheral wall with an upper section and a lower section; an upper tensioning assembly including an upper tensioning member slidably mounted to the housing and slidably along an upper tensioning path, the upper tensioning assembly urging the web of rolled product against the upper section of the peripheral wall of the dispensing roller when engaged with the dispensing assembly, the upper tensioning assembly providing a variable tension on the web of rolled product; a lower tensioning assembly including a lower tensioning member mounted to the housing and urging the web of paper against the lower section of the dispensing roller; and a biasing member having a first end connected to the upper tensioning assembly and a second end connected to the lower tensioning assembly, the biasing member biasing at least the upper tensioning assembly towards the lower tensioning assembly.

In an embodiment, the lower tensioning assembly provides a variable tension on the web of rolled product and the biasing member also biases the lower tensioning member towards the upper tensioning assembly.

In an embodiment, the upper tensioning assembly and the lower tensioning assembly are configurable between a full tension configuration and a lower tension configuration, the upper tensioning assembly and the lower tensioning assembly being configured for the web of rolled product to cover more than about 60% of the peripheral wall of the dispensing roller when configured in the full tension configuration. The upper tensioning assembly and the lower tensioning assembly can be configured for the web of rolled product to cover between about 60% and about 75% of the peripheral wall of the dispensing roller when configured in the full tension configuration.

In an embodiment, the dispensing assembly further comprises at least one finger stripper connected to the upper tensioning assembly and the lower tensioning assembly and extending rearwardly of the peripheral wall of the dispensing roller, the at least one finger stripper defining a web path with the peripheral wall of the dispensing roller, the web of the rolled product at least partially contouring the upper tensioning member and the lower tensioning member and extending in the web path when engaged with the dispensing assembly.

In an embodiment, the housing comprises at least two spaced-apart supporting members supporting the dispensing roller on opposed ends thereof with each one of the supporting members comprising an upper groove defined therein and defining the upper tensioning path and wherein the upper tensioning member comprises an upper tensioning roller slidably engaged in an upper grooves of the supporting members and being slidable along the upper tensioning path. The upper tensioning path defined by the upper grooves can conform to a section of the peripheral wall of the dispensing roller and can be spaced apart therefrom. The upper grooves can have a lower and forward end and wherein the biasing member can be connected to the upper tensioning member and can biase the upper tensioning member towards the lower ends of the upper grooves.

In an embodiment, the housing comprises at least two spaced-apart supporting members supporting the dispensing roller on opposed ends thereof with each one of the supporting members comprising a lower groove defined therein and defining a lower tensioning path and wherein the lower tensioning assembly comprises a lower tensioning member comprises a lower tensioning roller slidably mounted in the lower grooves of the supporting members and being slidable along the lower tensioning path. The lower grooves can extend substantially tangentially to the peripheral wall of the dispensing roller. The lower grooves can have an upper end and wherein the biasing member can be connected to the lower tensioning roller and can biase the lower tensioning roller towards the upper ends of the lower grooves.

In an embodiment, the housing comprises at least two spaced-apart supporting members supporting the dispensing roller on opposed ends thereof with each one of the supporting members comprising an upper groove defined therein and defining the upper tensioning path and a lower groove defined therein and defining a lower tensioning path, and wherein the upper tensioning member comprises an upper tensioning roller slidably engaged in the upper grooves of the supporting members and being slidable along the upper tensioning path, and the lower tensioning member comprises a lower tensioning roller slidably engaged in the lower grooves of the supporting members and being slidable along the lower tensioning path. The upper tensioning path defined by the upper grooves can conform to a section of the peripheral wall of the dispensing roller and can be spaced apart therefrom. The lower grooves can extend substantially tangentially to the peripheral wall of the dispensing roller. The upper grooves can have a lower and forward end and wherein the biasing member can have a first end connected to the upper tensioning member and a second end connected to the lower tensioning member and biasing the upper tensioning member towards the lower ends of the upper grooves and the lower tensioning member towards the upper ends of the lower grooves.

In an embodiment, the rolled product dispenser further comprises a variable tension return assembly comprising: at least one eccentric attachment point spaced apart from the rotation center of the dispensing roller; at least one anchor provided on the housing; and a dispensing roller biasing member extending along a path and connecting one of the at least one eccentric attachment point and one of the at least one anchor, the dispensing roller biasing member being configurable in at least two extension states by modifying at least one of the at least one eccentric attachment point, the at least one anchor, and the path of the dispensing roller biasing member. The variable tension return assembly can comprise at least one of a plurality of eccentric attachment points positioned at different distances from one of the at least one anchor and a plurality of anchors positioned at different distances from one of the at least one eccentric attachment point. The variable tension return assembly can further comprise at least one tension adjusting pin mounted to the housing and engageable with the dispensing roller biasing member between the at least one eccentric attachment point and the at least one anchor, each of the at least one tension adjusting pin being positioned to vary an angular position of the dispensing roller upon engagement with the dispensing roller biasing member.

According to a further general aspect, there is provided a rolled product dispenser for dispensing a web of rolled product. The rolled product dispenser comprises: a housing; a dispensing assembly at least partially housed in the housing and interacting with the web of rolled product, the dispensing assembly having a dispensing roller with a rotation center; and a variable tension return assembly. The variable tension return assembly comprises at least one eccentric attachment point spaced apart from the rotation center of the dispensing roller; at least one anchor provided on the housing; and a dispensing roller biasing member extending along a path and connecting one of the at least one eccentric attachment point and one of the at least one anchor, the dispensing roller biasing member being configurable in at least two extension states by modifying at least one of the at least one eccentric attachment point, the at least one anchor, and the path of the dispensing roller biasing member.

In an embodiment, the variable tension return assembly comprises at least one of a plurality of eccentric attachment points positioned at different distances from one of the at least one anchor and a plurality of anchors positioned at different distances from one of the at least one eccentric attachment point. The variable tension return assembly can further comprise at least one tension adjusting pin mounted to the housing and engageable with the dispensing roller biasing member between the at least one eccentric attachment point and the at least one anchor, each of the at least one tension adjusting pin being positioned to vary an angular position of the dispensing roller upon engagement with the dispensing roller biasing member.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which:

FIGS. 7*a* to 7*c* are schematic side elevation views of the rolled product dispenser according to another embodiment and including a variable tension return assembly with tension adjusting pins, wherein FIG. 7*a* shows a biasing member engaging a first tension adjusting pin; FIG. 7*b* shows the biasing member engaging a second tension adjusting pin; and FIG. 7*c* shows the biasing member engaging a third tension adjusting pin.

DETAILED DESCRIPTION

In the following description, the same numerical references refer to similar elements. The embodiments, geometrical configurations, materials mentioned and/or dimensions shown in the figures or described in the present description are preferred embodiments only, given solely for exemplification purposes.

Moreover, although the embodiments of the rolled product dispenser and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, can be used for the rolled product dispenser, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
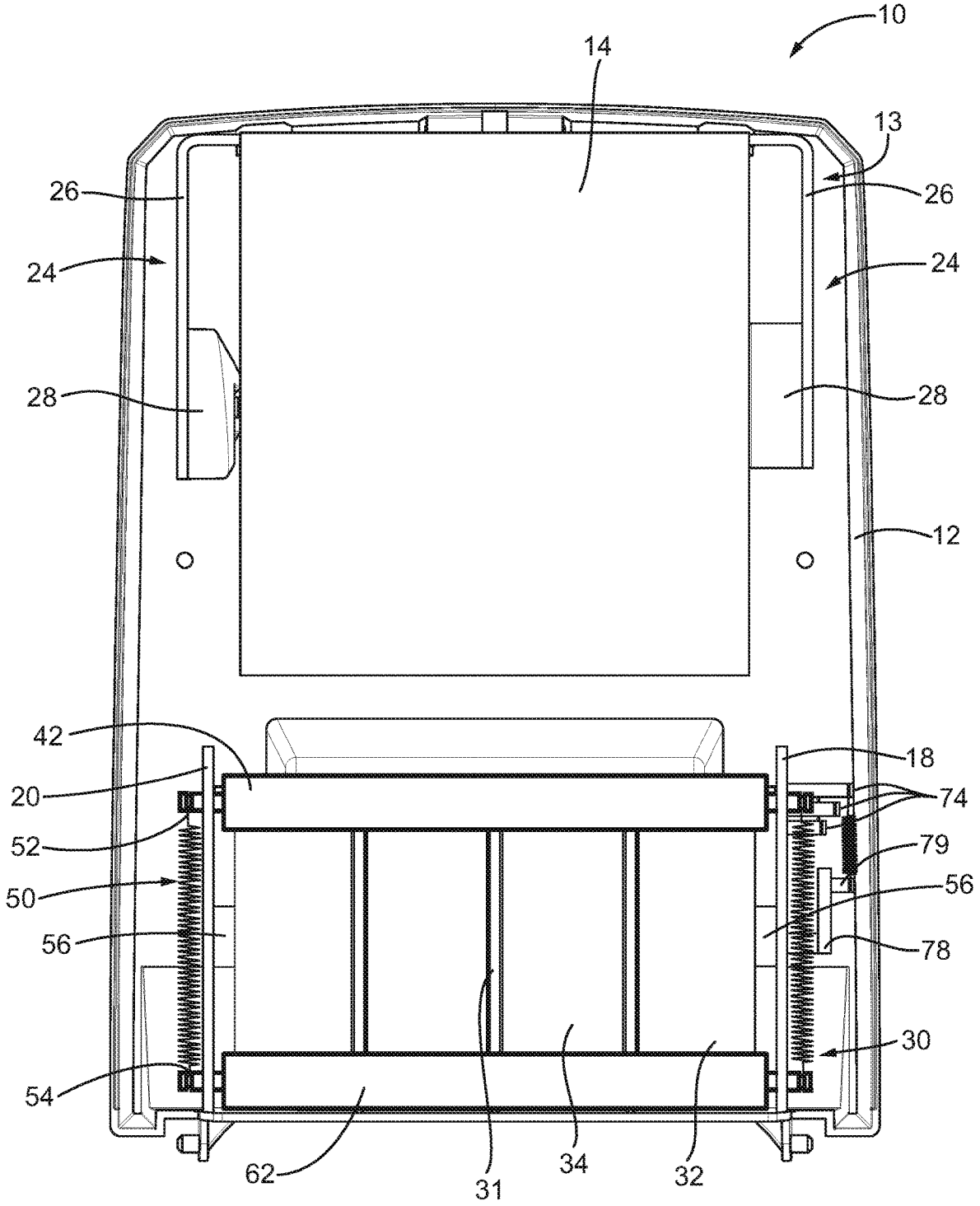
FIG. 1 is a front elevation view of a rolled product dispenser according to an embodiment, wherein a cover of the rolled product dispenser has been removed.
Figure 2:
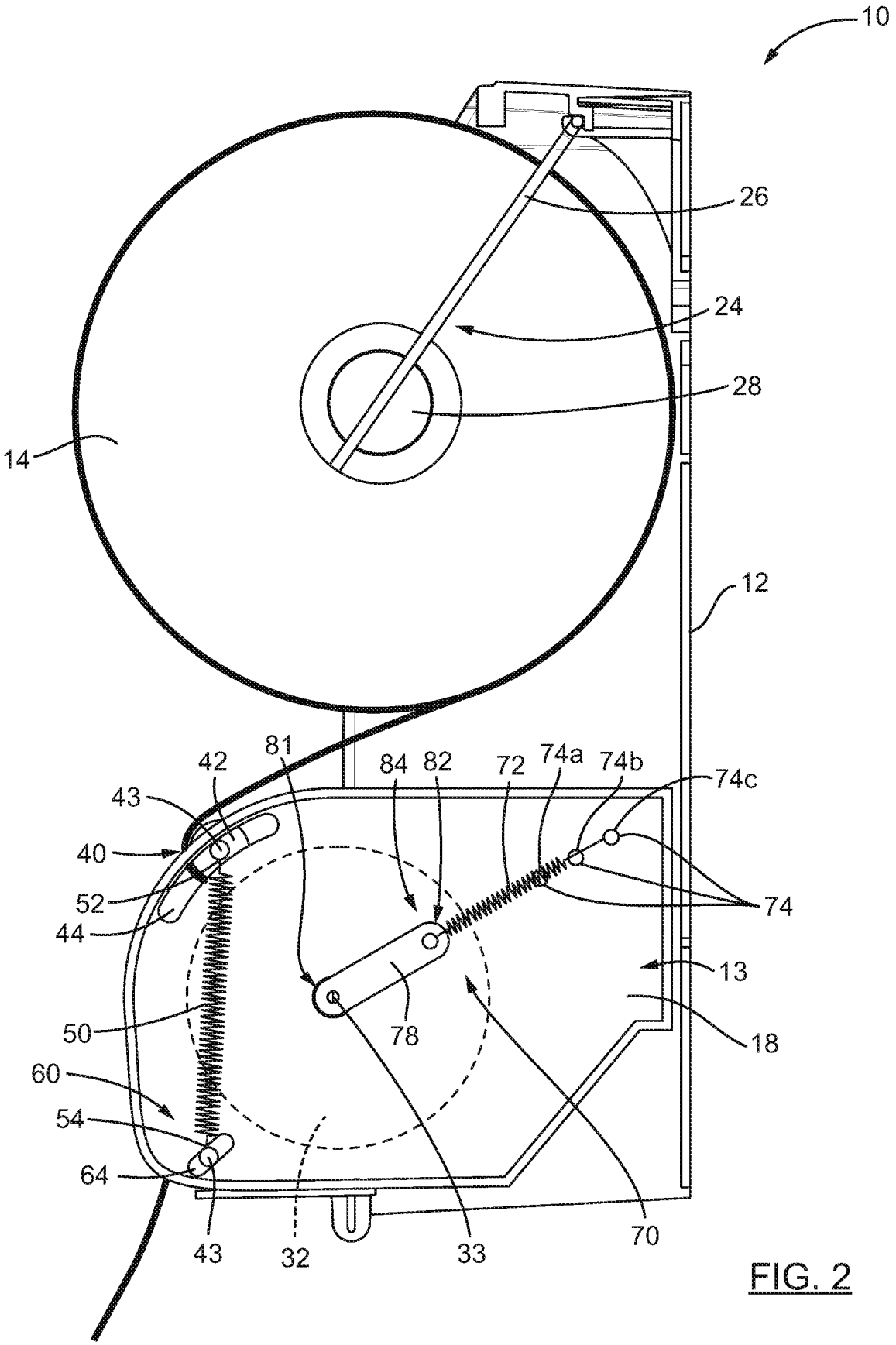
FIG. 2 is a side elevation view of the rolled product dispenser of FIG. 1.
Figure 3:
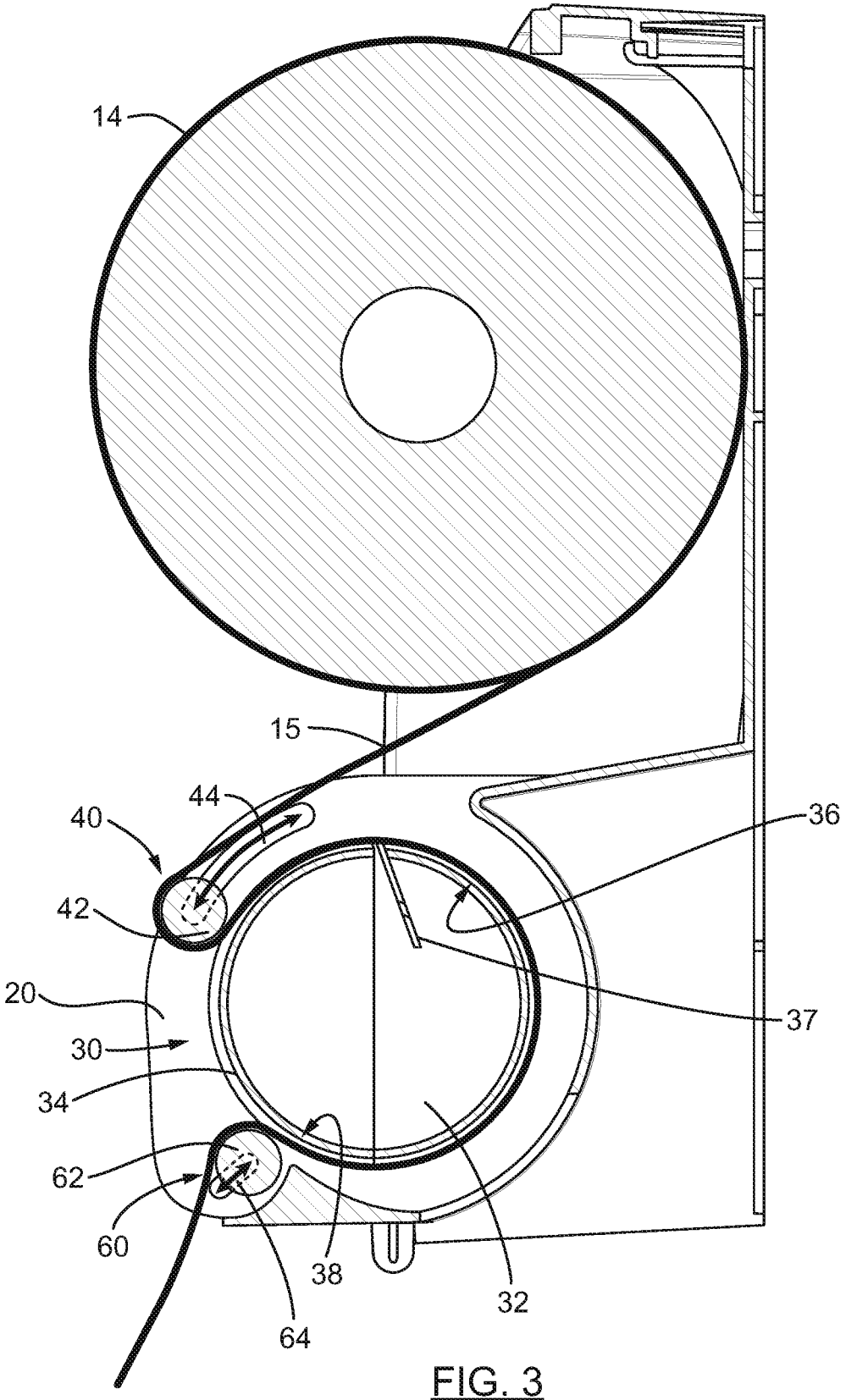
FIG. 3 is a cross sectional side view of the rolled product dispenser of FIG. 1, where the upper tensioning assembly and the lower tensioning assembly are configured in a full tension configuration.

Referring now to the drawings and, more particularly, referring to FIGS. 1 to 3, there is shown an embodiment of a rolled product dispenser 10 including a housing 12 defining a dispensing assembly chamber 13 and including supporting members 18, 20 extending in the dispensing assembly chamber 13. The dispensing assembly chamber 13 in combination with the supporting members 18, 20 are configured to contain a rolled product 14 such as, without being limitative, hand paper (or paper towel), and a dispensing assembly 30. The dispensing assembly 30 includes a dispensing roller 32, mounted to and extending between the supporting members 18, 20, which support the dispensing roller 32 at opposed ends thereof. The dispensing roller 32 is operative to dispense lengths of a web 15 of the rolled product 14 to a user. As will be easily understood by one skilled in the art, the rolled product 14 can be a web of absorbent sheet product provided in rolled configuration, such as and without being limitative, hand paper towel. However, the rolled product 14 can be any type of paper provided in a roll, such as, but without being limitative, toilet paper, or other types of rolled product, such as cling film, foil or the like.

The housing 12 typically comprises a rear section and a protective cover. In the appended figures, solely the rear section of the housing 12 is shown. The protective cover can be mounted to the rear section, at the front of the housing 12, in order to cover the internal components of the dispensing assembly 30 and the rolled product 14. When engaged together, the rear section and the protective cover define the dispensing assembly chamber 13. The protective cover can be removably mounted to the rear section of the housing 12 using known mounting techniques such as clips, screws or the like.

In an embodiment, the housing 12 including its supporting members 18, 20 are made of moulded plastic such as acrylonitrile butadiene styrene (ABS). However, other materials offering similar characteristics can be used in the manufacture of the housing 12 and its supporting members 18, 20.

In the embodiment shown, the supporting members 18, 20 extend upwardly from a lower wall of the rear section of the housing 12. The supporting members 18, 20 can be moulded with the rear section of the housing, i.e. the supporting members 18, 20 can be integral to the rear section of the housing 12, or can be detachably mounted to the rear section of the housing 12. It is appreciated that, in an alternative embodiment, the supporting members 18, 20 can be defined in the lateral walls of the rear section of the housing 12, i.e. they are not spaced-apart from the lateral walls of the rear section of the housing 12 but defined therein.

Referring to FIGS. 1 and 2, in an embodiment, the rolled product dispenser 10 comprises a roll support 24, mounted to the housing 12 and extending in the dispensing assembly chamber 13, for supporting the rolled product 14 inside the dispensing assembly chamber 13. In a non-limitative embodiment, the roll support 24 comprises a structure presenting two spaced-apart support arms 26 pivotally mounted to the housing 12, with a respective one of the support arms 26 extending on each side of the rolled product 14. A rolled product connector 28 is mounted to an end of each one of the support arms 26 and is engageable with the rolled product 14. The rolled product connectors 28 face one another in the dispensing assembly chamber 13. More particularly, to engage a rolled product 14 between the two support arms 26, the rolled product connectors 28 are inserted in a central bore of the rolled product 14, at a respective end thereof.

In an embodiment, the support arms are made of flexible material, such that the flexibility of the arms 26 allows the roll support 24 to be easily spread open in order to refill the rolled product dispenser 10 with a new roll of rolled product 14, when necessary. As will be easily understood by one skilled in the art, in alternative embodiments, other types of roll supports, providing adequate support to the rolled product 14 and easy refill of the rolled product dispenser 10 can be used in connection with the dispenser 10. In an embodiment, such as the one shown in FIGS. 3 and 4, the roll support 24 is configured such that, when engaged with the rolled product connectors 28, the rolled product 14 abuts on a rear wall of the housing 12 to create friction between the housing 12 and the rolled product 14.

The dispensing assembly 30 of the rolled product dispenser 10 is configured to dispense lengths of the web 15 of the rolled product 14 to a user. In an embodiment, the dispensing assembly 30 comprises a dispensing roller 32 mounted to and extending between the supporting members 18, 20. As shown in FIG. 1, the dispensing roller 32 can be rotatably mounted to the supporting members 18, 20, using projections 56 located at both ends of the dispensing roller 32, and extending into the supporting members 18, 20. The dispensing roller 32 rotates about its rotation axis, aligned with its rotation center 33.

Now referring to FIGS. 1 to 4, the dispensing roller 32 has a peripheral wall 34 which can be divided into an upper section 36 and a lower section 38. The upper section 36 and the lower section 38 extend respectively above and below a horizontal plane aligned with the rotation center 33. In an embodiment, the peripheral wall 34 of the dispensing roller 32 can be made of a friction-enhanced material (or anti-skid material) in order to increase the friction between the dispensing roller 32 and the web 15 of the rolled product 14. The dispensing roller 32 can also be provided with a plurality of spaced-apart annular grooves 31 running along its periphery. In an embodiment, the dispensing roller 32 can comprise a cutting assembly 37 for cutting a section of the web 15 of the rolled product 14 and thereby allow the dispensing of lengths of the rolled product 14 to users. The cutting assembly 37 can be housed in the dispensing roller 32. For instance, the cutting assembly can be similar to the one described in international patent application no. WO2013/044385, published on Apr. 4, 2013, which is hereby incorporated by reference in its entirety.

In an embodiment, the dispensing assembly 30 includes an upper tensioning assembly 40 which pulls the web 15 of the rolled product 14 forwardly, before it extends rearwardly (i.e. towards the rear wall of the housing 12) to at least partially contour the upper section 36 of the dispensing roller 32. The upper tensioning assembly 40 is mounted above the horizontal plane aligned with the rotation center 33. The upper tensioning assembly 40 includes an upper tensioning member 42, such as an upper tensioning roller, mounted to and extending between the supporting members 18, 20, and pulling the web 15 of the rolled product 14 forwardly and downwardly towards a front section of the dispensing roller 32 (i.e. the front section of the housing 12), therefore resulting in the web 15 of the rolled product 14 being pulled or pressed against a section of the upper section 36 of the peripheral wall 34 of the dispensing roller 32 to cover a larger section thereof. The upper tensioning member 42 can be configured to either abut with the dispensing roller 32 (not shown) or be spaced-apart from the dispensing roller 32 (as shown in FIGS. 3 and 4).

Figure 4:
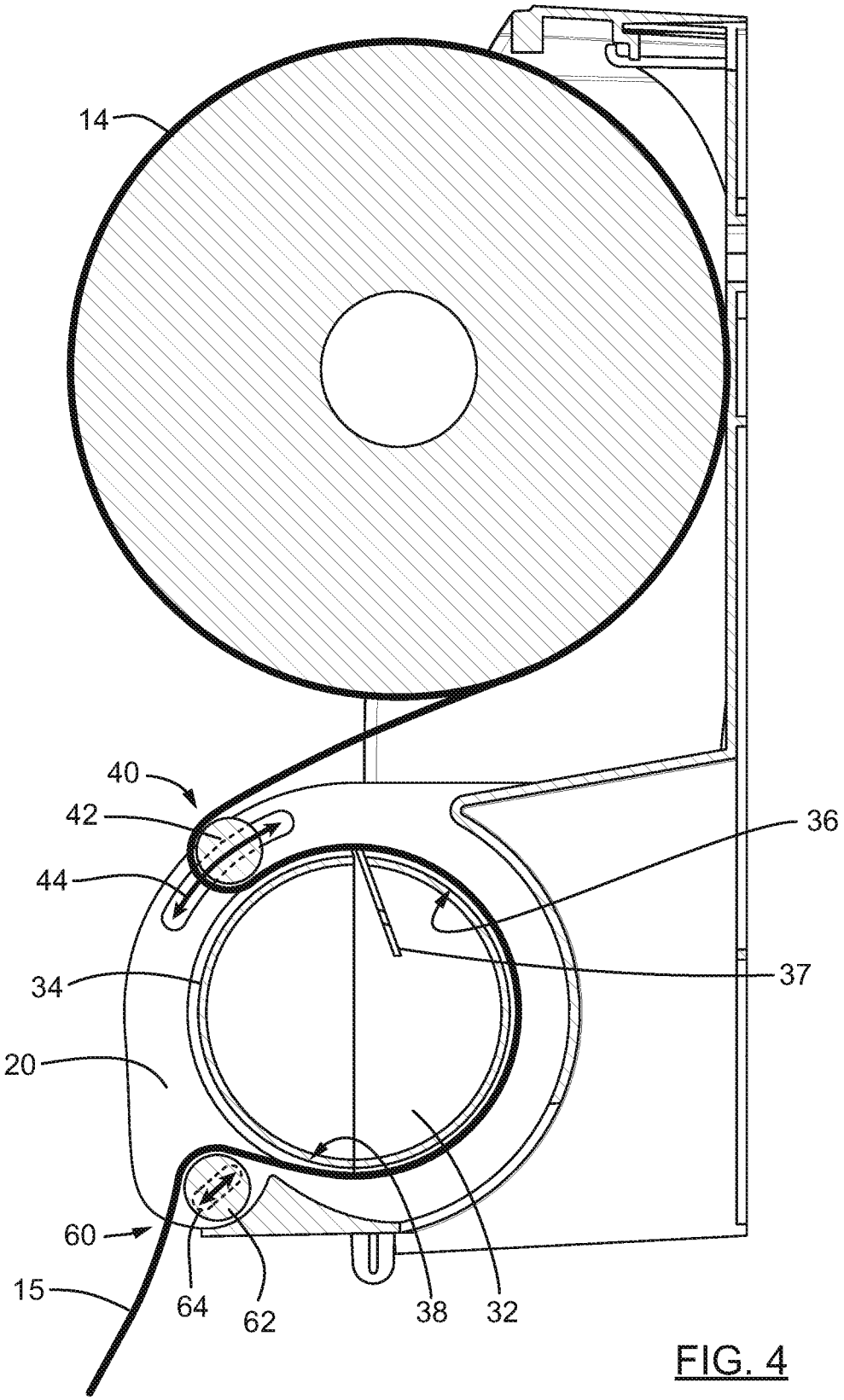
FIG. 4 is a cross sectional side view of the rolled product dispenser of FIG. 1, where the upper tensioning assembly and the lower tensioning assembly are configured in a lower tension configuration.

As can be seen in FIGS. 2 to 4, in the embodiment shown, the upper tensioning member 42 is slidably mounted in an upper groove 44 defined in the each one of the supporting members 18, 20. Thus, the length of web 15 of the rolled product 14 which contours the upper section 36 of the dispensing roller 32 is variable. The upper tensioning member 42 is engaged in the upper groove 44 through a tensioning member connector 43 freely slidable along the upper groove 44. For example, the tensioning member connector 43 can be an extension rod, a bearing assembly or other types of connector which allow free displacement along the upper groove 44. It will be understood that, when the upper tensioning member 42 is positioned at the lower and forwardmost end of the upper groove 44 (as shown in FIG. 3), the length of the web 15 of the rolled product 14 which contours the upper section 36 of the dispensing roller 32 is higher than when the upper tensioning member 42 is positioned further up and rearwardly of the upper groove 44 (as shown in FIG. 4). In an embodiment, the upper groove 44 defines an arc of a circle. In an embodiment, the upper groove 44 defines a path substantially parallel to a section of the peripheral wall 34 and spaced apart therefrom, such that the upper tensioning member 42 is displaced in parallel to the peripheral wall 34 of the dispensing roller 32, i.e. the upper groove 44 conforms to the section of the peripheral wall 34 of the dispensing roller 32, but is spaced apart therefrom. In other words, the upper groove 44 has a shape substantially similar to a corresponding section of the peripheral wall 34, such that both components form similar curves, spaced-apart from one another.

In an embodiment, the upper tensioning member 42 is biased towards a lower end of the upper groove 44 by a biasing member 50. In the embodiment shown, the biasing member 50 is a spring, however one skilled in the art will understand that, in alternative embodiments, the biasing member 50 can be another type of resilient element biasing the upper tensioning member 42 towards the lower end of the upper groove 44. It will also be understood that, even though in the embodiment of FIG. 2, the biasing member 50 is connected at a first end 52 to the upper tensioning member 42 and at a second end 54 to a lower tensioning assembly, which will be described in more details below, the biasing member 50 can be connected at the second end 54 to other elements, such as, for example, a rear section of the housing 12 or the supporting members 18, 20, at an attachment point located below and/or forward from the lower end of the upper groove 44.

Between user interactions, the upper tensioning member 42 is biased towards the lower end of the upper groove 44, therefore applying the highest tension on the web 15 of the rolled product 14 and resulting in the longest length of web 15 of the rolled product 14 contouring the upper section 36 of the dispensing roller 32. When the end of the web 15 of the rolled product 14 is grasped and pulled by a user, the additional tension imparted on the web 15 of the rolled product 14 by the pull results in the upper tensioning member 42 being brought momentarily upwards and rearwards along the upper groove 44, before being forced back towards the lower end of the upper groove 44 by the biasing member 50. This sequence of operation results in a dampening of the effects of the user's pull, on the rolled product 14, therefore reducing overspinning of the rolled product 14 inside the dispensing assembly chamber 13.

Still referring to FIGS. 1 to 4, in an embodiment, the dispensing assembly 30 further comprises a lower tensioning assembly 60 including a lower tensioning member 62, such as a lower tensioning roller, mounted to and extending between the supporting members 18, 20. The lower tensioning member 62 pulls the web 15 of the rolled product 14 upwards towards the front of the dispensing roller 32, thereby pulling the web 15 of the rolled product 14 against the lower section 38 of the peripheral wall 34 of the dispensing roller 32. Similarly to the upper tensioning member 42, the lower tensioning member 62 can be configured to either abut with the dispensing roller 32 (not shown) or be spaced-apart from the dispensing roller 32, as shown in FIGS. 3 and 4.

As can be seen in FIGS. 2 to 4, in the embodiment shown, the lower tensioning member 62 is slidably mounted in a lower groove 64 defined in each one of the supporting members 18, 20, to vary the tension imparted on the web 15 of the rolled product 14 contouring the dispensing roller 32. Once again, the lower tensioning member 62 is operatively engaged with the lower groove 64 through a tensioning member connector 43, such as an extension rod, a bearing assembly or the like, in order to be freely slidable along the lower groove 64. When the lower tensioning member 62 is positioned at an upper end of the lower groove 64 (as shown in FIG. 3), the tension imparted on the web 15 of the rolled product 14 is higher than when the lower tensioning member 62 is positioned further down the lower groove 64 (as shown in FIG. 4). In an embodiment, the lower groove 64 extends substantially tangentially to the peripheral wall 34 of the dispensing roller 32.

In an embodiment, the upper groove 44 extends between an angular position of about 20° and about 85° or between about 30° and about 75°, clockwise from a section of the above-mentioned horizontal plane aligned with the rotation center 33 of the dispensing roller 32, forward of the dispensing roller 32, and/or extends along a range of between above about 20° or between about 30° and about 50°. the lower groove 64 extends substantially tangentially to the peripheral wall 34 of the dispensing roller 32 at an angular position between about 290° and about 330° or between about 300° and about 320° clockwise from the section of the above-mentioned horizontal plane aligned with the rotation center 33 of the dispensing roller 32 positioned, forward of the dispensing roller 32.

One skilled in the art would understand that, in an alternative embodiment (not shown), the lower tensioning assembly 60 can be free of lower groove 64. In such an embodiment the lower tensioning member 62 is located at a fixed position relative to the dispensing roller 32, which results in a fixed length of the web 15 of the rolled product 14 contouring the lower section 38 of the dispensing roller 32.

In the embodiment shown, the lower tensioning member 62 is biased towards the upper end of the lower groove 64 by the biasing member 50. As mentioned above, in the embodiment shown, the biasing member 50 is a spring, however one skilled in the art would understand that, once again, the biasing member 50 can be another type of resilient element biasing the lower tensioning member 62 towards the upper end of the lower groove 64. It will also be understood that, even though, in the embodiment of FIG. 2, the biasing member 50 is connected at the first end 52 to the upper tensioning member 42 and at the second end 54 to the lower tensioning assembly 60, the biasing member 50 can be connected at the first end 52 to other elements, such as, the rear section of the housing 12 or the supporting members 18, 20, at an attachment point located above and/or rearward from the upper end of the lower groove 64.

In the default configuration, the biasing member 50 biases the lower tensioning member 62 towards the upper end of the lower groove 64 and applies the highest tension on the web 15 of the rolled product 14, which results in the longest length of the web 15 of the rolled product 14 abutting the lower section 38 of the dispensing roller 32. When the end of the web 15 of the rolled product 14 is grasped and pulled by a user, the additional tension imparted on the web 15 of the rolled product 14 by the pull causes the lower tensioning member 62 to be brought momentarily downward along the lower groove 64, before being forced back towards the upper end of the lower groove 64 by the biasing member 50. When the lower tensioning member 62 is brought momentarily downward along the lower groove 64, a section of the web 15 of the rolled product 14 moves away from the lower section 38 of the peripheral wall 34 of the dispensing roller 32. This results in a dampening of the effects of the user's pull, on the rolled product 14, and therefore reduces the chances of overspinning of the rolled product 14.

FIGS. 1 to 4 show an embodiment, where both the upper tensioning assembly 40 and the lower tensioning assembly 60 are provided. In such an embodiment and as mentioned above, the biasing member 50 can be connected at the first end 52 to the upper tensioning member 42 and at the second end 54 to the lower tensioning member 62 in order to connect both tensioning assemblies 40, 60 together.

The combination of the upper tensioning assembly 40 and the lower tensioning assembly 60 results in the web 15 of the rolled product 14 being wrapped around a larger section of the dispensing roller 32 and increases the friction between the web 15 of the rolled product 14 and the dispensing roller 32. Such a combination can result in the web 15 of the rolled product 14 covering more than about 60% of the surface of the peripheral wall 34 of the dispensing roller 32 and, in an embodiment, between about 60% and about 75% of the surface of the peripheral wall 34 of the dispensing roller 32 when the upper tensioning assembly 40 and the lower tensioning assembly 60 are configured in a full tension configuration, i.e. a configuration where the upper tensioning member 42 and the lower tensioning member 62 are configured such that the longest length of web 15 of the rolled product 14 contours the dispensing roller 32 (see FIG. 3). In an embodiment, the web 15 of the rolled product 14 covers about 75% of the surface of the upper section 36 of the peripheral wall 34 of the dispensing roller 32 when the upper tensioning assembly 40 is configured in the full tension configuration and the web 15 of the rolled product 14 covers about 70% of the surface of the lower section 38 of the peripheral wall 34 of the dispensing roller 32 when the lower tensioning assembly 60 is configured in the full tension configuration.

The dampening provided by the combination of the upper tensioning assembly 40 and the lower tensioning assembly 60 slidably mounted to move between the full tension configuration and a lower tension configuration, i.e. where the upper tensioning member 42 and the lower tensioning member 62 are configured such that a smaller length of web 15 of the rolled product 14 contours the dispensing roller 32, further reduces overspinning of the rolled product 14, when the web of rolled paper is pulled sharply.

In some embodiments, the dispensing assembly 30 can comprise only one of the upper tensioning assembly 40 and the lower tensioning assembly 60. In these embodiments, the biasing member 50 associated to the one of the upper tensioning assembly 40 and the lower tensioning assembly 60 has a first end mounted to the respective tensioning member and a second end connected to another element of the housing 12, such as the rear section of the housing 12 or the supporting members 18, 20.

Figure 5:
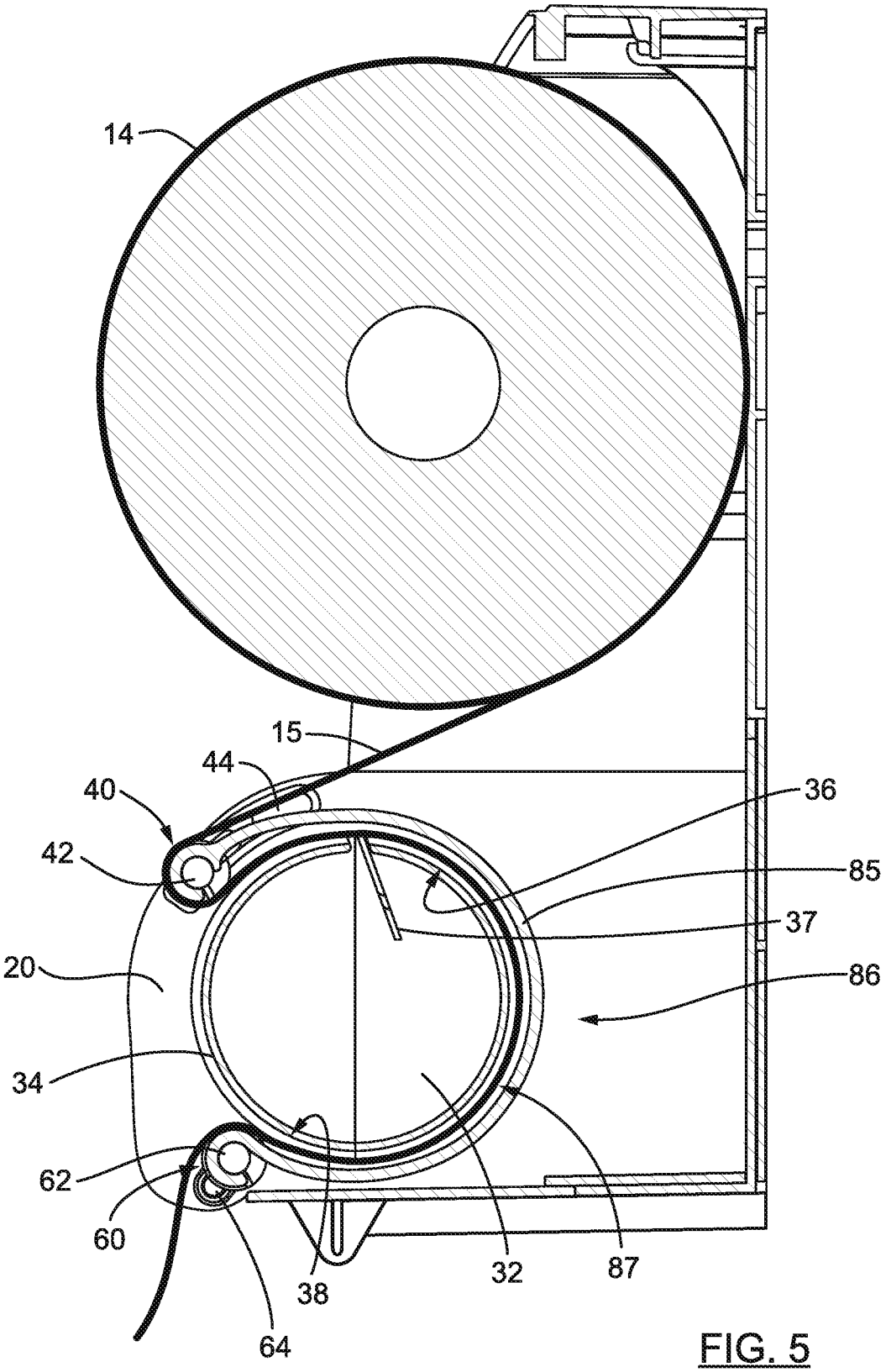
FIG. 5 is a cross sectional side view of the rolled product dispenser according to another embodiment and including finger strippers extending between the upper tensioning roller and the lower tensioning roller.
Figure 6:
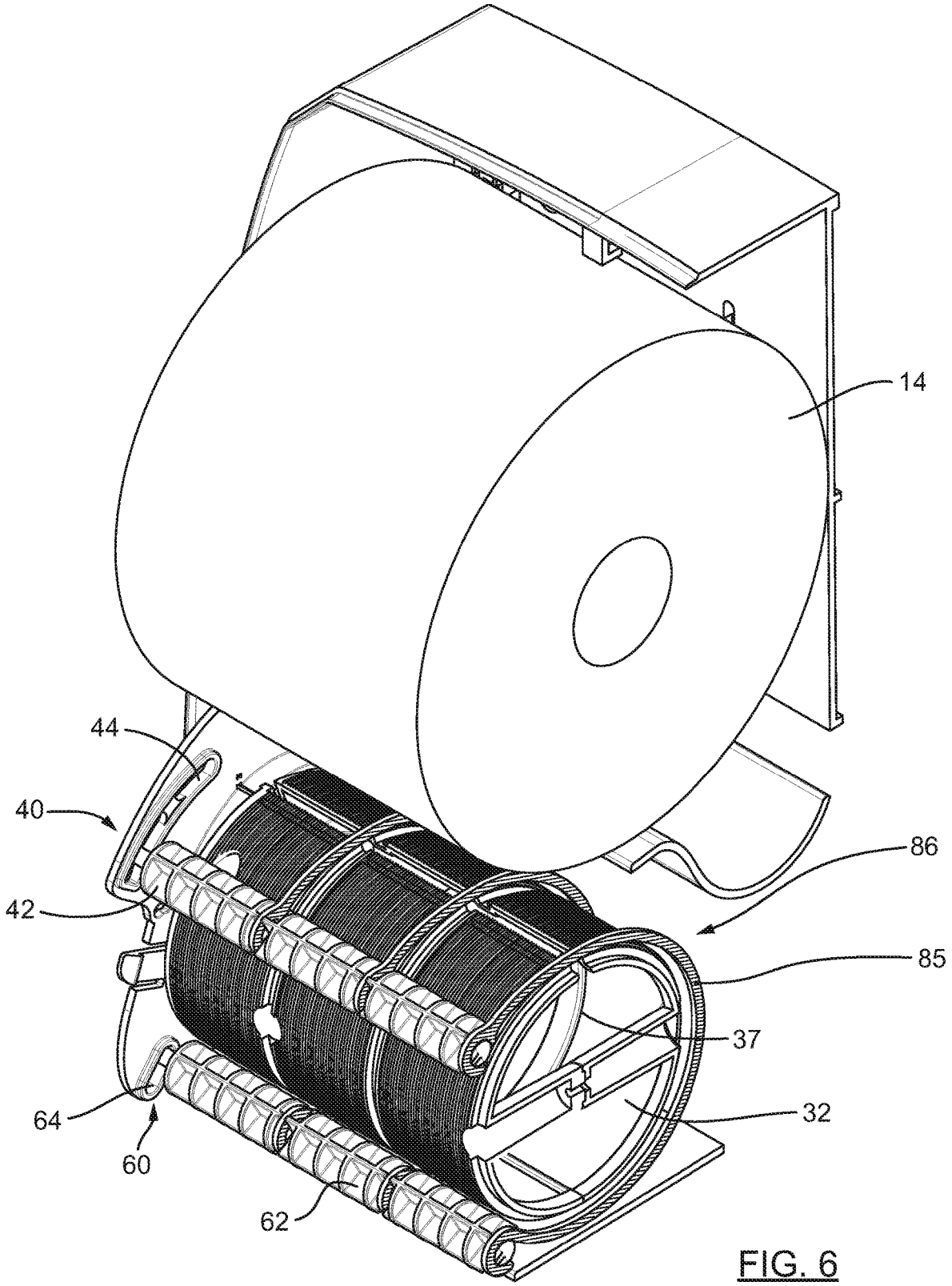
FIG. 6 is a perspective view of the rolled product dispenser of FIG. 5 wherein part of a rear wall of the housing has been removed.

Referring to FIGS. 5 and 6, in an embodiment, the upper tensioning member 42 and the lower tensioning member 62 can be connected by at least one finger stripper 85 guiding the web 15 of the rolled product 14 around the dispensing roller 32. As can be seen, the finger strippers 85 are elongated strips of flexible material extending rearwardly between the upper tensioning member 42 and the lower tensioning member 62 and connecting same. the finger strippers 85 extend rearwardly of the peripheral wall 34 of the dispensing roller 32 and define a web path 87 with the peripheral wall 34 of the dispensing roller 32. As can be seen, the web 15 of the rolled product 14 at least partially contours the upper tensioning member 42 and the lower tensioning member 62 and extends in the web path 87.

In the embodiment shown, three spaced apart fingers strippers 85 are provided between the upper tensioning member 42 and the lower tensioning member 62. The finger strippers 85 define a guide 86 for guiding the web 15 of the rolled product 14 around the dispensing roller 32. The distance between the guide 86 and the dispensing roller 32 is variable according to the configuration of the upper tensioning member 42 and the lower tensioning member 62. As will be understood, when the upper tensioning member 42 and the lower tensioning member 62 are configured in the full tension configuration, the distance is smaller and the resulting guidance is superior than when at least one of the upper tensioning member 42 and the lower tensioning member 62 are configured in a lower tension configuration.

One skilled in the art will understand that, in alternative embodiments, an upper tensioning assembly 40 or a lower tensioning assembly 60 can also be provided independently.

Referring back to FIGS. 1 and 2, in an embodiment the rolled product dispenser 10 is further provided with a variable tension return assembly 70 for returning the dispensing roller 32 to the initial angular position, following a rotation thereof. It will be understood that the variable tension return assembly 70 can be provided independently or in combination with either one, or both of the upper tensioning assembly 40 and the lower tensioning assembly 60. When the variable tension return assembly 70 is provided in combination with at least one of the upper tensioning assembly 40 and the lower tensioning assembly 60, the presence of a tensioning assembly reduces the slippage between the web 15 of the rolled product 14 and the dispensing roller 32, which can be caused by the additional rotatory resistance of the dispensing roller 32 created by the variable tension return assembly 70.

In the embodiment shown, the variable tension return assembly 70 includes a dispensing roller biasing member 72, such as, without being limitative, a spring, extending along a path and connecting the dispensing roller 32 and an anchor 74 provided on the housing 12, such as the rear section of the housing 12 or at least one of the supporting members 18, 20. Thus, a distal end of the dispensing roller biasing member 72 is connected to the anchor 74.

A proximal end of the dispensing roller biasing member 72 is connected to an eccentric attachment point 84 with respect to the dispensing roller 32, i.e. a connection point spaced apart from the rotation center 33 of the dispensing roller 32. The eccentric attachment point 84 is provided by a connection arm 78 mounted to the dispensing roller 32. The connection arm 78 has a proximal end 81 proximate to the rotation center 33 of the dispensing roller 32 and a distal end 82 spaced apart from the rotation center 33 of the dispensing roller 32. The connection arm 78 is secured to the dispensing roller 32 to rotate simultaneously therewith. The distal end 82 of the connection arm 78 includes the eccentric attachment point 84 for engaging the dispensing roller biasing member 72. An extension head 79 (FIG. 1) can further be provided at the distal end 82 of the connection arm 78 to attach the dispensing roller biasing member 72 thereto. In an alternative embodiment, the extension head 79 can be rotatable, as will be described in more details below in reference to FIGS. 7*a* to 7*c*.

The presence of a return assembly 70 causes the dispensing roller 32 to rotate back to its original angular position within the dispensing assembly chamber 13 of the rolled product dispenser 10 following a rotation caused by a pull on the end of the web 15 of the rolled product 14 by a user. Such a return assembly 70 contributes to adjust the length of the web 15 of the rolled product 14 extending outwardly of the housing 12 following a pull, which should be long enough to allow a user to seize the web 15 of product for a subsequent pull and relatively short to reduce, for instance, bacterial contamination, product waste or the like.

Still referring to FIGS. 1 and 2, in order to provide a variable tension of the dispensing roller biasing member 72, i.e. in order to allow the dispensing roller biasing member 72 to be configured in different extension states, and thereby control the length of the product extending outwardly of the housing 12, in an embodiment, the rolled product dispenser 10 and, more particularly, the housing 12 comprises a plurality of spaced-apart anchors 74. The anchors 74 are provided at different distances from the eccentric attachment point 84. Therefore, depending on the desired tension (or extension state) of the dispensing roller biasing member 72, an operator can manually attach the distal end of the dispensing roller biasing member 72 to one of the plurality of anchors 74. The dispensing roller biasing member 72 can be attached to a first anchor 74*a*, located closest to the attachment point 84, when the lowest tension is desired, to a second anchor 74*b* located further away from the attachment point 84 when a higher tension is desired, and to a third anchor 74*c* located farthest away from the attachment point 84 when the highest tension is desired. In an embodiment, the first anchor 74*a*, the second anchor 74*b*, and the third anchor 74*c* are aligned about a common axis.

It will be understood that even though three anchors 74 aligned about a common axis are provided in the embodiment shown, in an alternative embodiment, a different amount of anchors 74 can be provided and the anchors 74 can be positioned differently than in the embodiment shown. Moreover, in an alternative embodiment (not shown), the variable tension of the dispensing roller biasing member 72 can be provided by different eccentric attachment points 84 provided along the length of the connection arm 78. The different eccentric attachment points 84 provided along the length of the connection arm can be combined independently or in combination with the above-described plurality of anchors 74 located on the housing 12.

Figure 7C:
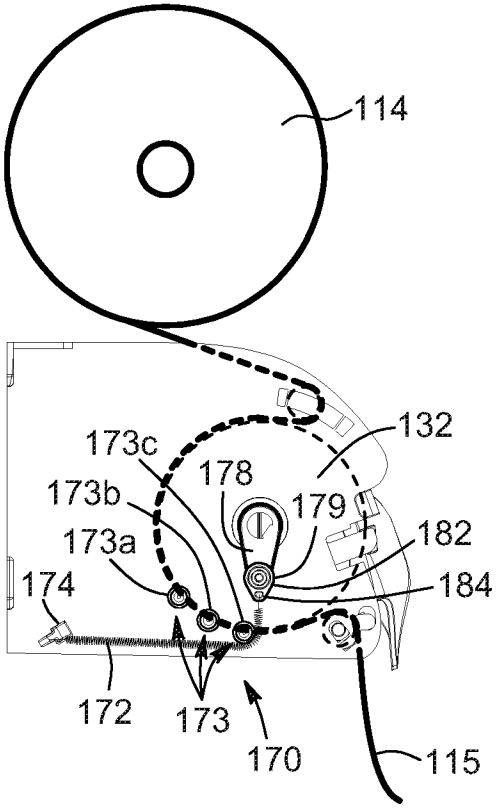
Figure 7B:
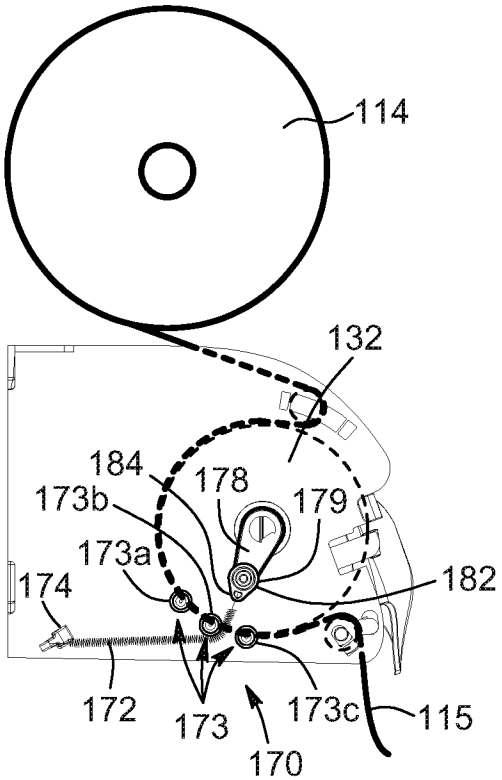
Figure 7A:
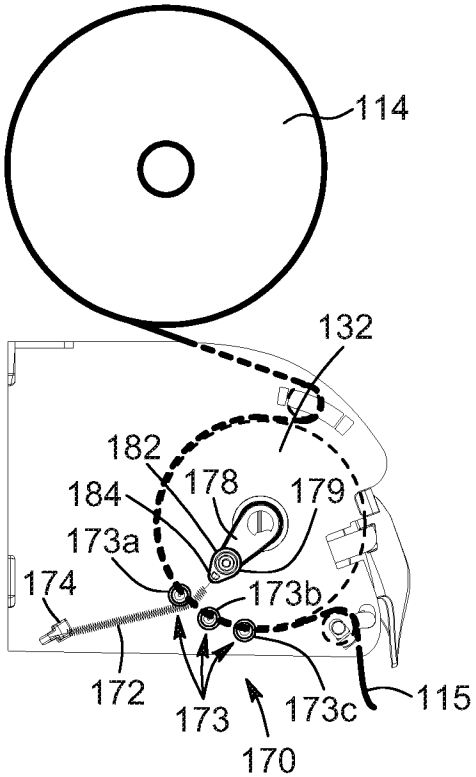

Now referring to FIGS. 7*a* to 7*c*, there is shown an alternative embodiment of the variable tension return assembly 170 wherein the features are numbered with reference numerals in the 100 series which correspond to the reference numerals of the previous embodiment. In this embodiment, the variable tension return assembly 170 comprises tension adjusting pins 173 provided between the anchor 174 and the attachment point 184 to modify the path of the dispensing roller biasing member 172 and provide the above-mentioned variable tension on the dispensing roller biasing member 172. In the embodiment shown, the tension adjusting pins 173 replace the plurality of anchors 74 and/or attachment points 84 of the above-described embodiment.

More particularly, in the embodiment shown, the eccentric attachment point 184 is provided on the extension head 179, which is rotatably connected to the connection arm 178, at the distal end 182 thereof, to attach the dispensing roller biasing member 172 thereon.

The tension adjusting pins 173 are positioned such that engagement between the dispensing roller biasing member 172 and a corresponding one of the tension adjusting pin 173, between the anchor 174 and the eccentric attachment point 184, results in the tension imparted on the dispensing roller biasing member 172 being increased and the angular position of the dispensing roller 132 being varied. As can be seen, in an embodiment, a plurality of tension adjusting pins 173 are provided and each one of the tension adjusting pins 173 provides a different tension on the dispensing roller biasing member 172 and a different angular position of the dispensing roller 132. In the embodiment shown, the angular position of the dispensing roller 132 is such that the length of the web 115 of the rolled product 114 extending outwardly of the housing, following a pull by as user, is the shortest when the dispensing roller biasing member 172 is engaged around the first tension adjusting pin 173*a* (See FIG. 7*a*) and increases when the dispensing roller biasing member 172 is engaged around the second tension adjusting pin 173*b* (see FIG. 7*b*) and the third tension adjusting pin 173*c* (see FIG. 7*c*) respectively.

The above described tension adjusting pin assembly allows easy adjustment, by an operator, of the tension imparted on the dispensing roller biasing member 172 and the angular position of the dispensing roller 132. Indeed, in order to adjust the tension imparted on the dispensing roller biasing member 172 and the angular position of the dispensing roller 132, an operator can simply configure the dispensing roller biasing member 172 such that it engages the desired tension adjusting pin 173*a* to 173*c*, without disconnecting the ends of the dispensing roller biasing member 172 from the anchor 174 and the attachment point 184 respectively.

One skilled in the art will understand that even though, FIGS. 7*a* to 7*c* show an embodiment where a single anchor 174 is provided, in an alternative embodiment, the tension adjusting pins 173 can be used in combination with multiple anchors 174, as described above, or with a plurality of eccentric attachment points 184.

Since it is desirable to provide different tensions of the dispensing roller biasing member 72, 172 for different types of paper, the tension can therefore be adjusted according to the type of paper being dispensed by the rolled product dispenser 10. A lower tension can be set when the paper is more delicate, while a higher tension can be set for types of paper having a higher resistance.

One skilled in the art will understand that, in alternative embodiments, other configurations providing the ability to manually vary the tension imparted on the dispensing roller biasing member 72, 172 and/or the original angular position of the dispensing roller 32, 132 can also be provided. For example and without being limitative, as mentioned above, a single anchor 74, 174 can be provided on the housing, with a plurality of attachment point 84, 184 at different distances from the anchor 74, 174. Alternatively, a plurality of anchors and a plurality of attachment points 84, 174 can also be provided. The plurality of attachment points 84, 184 can be provided along the connection arm 78, 178.

Several alternative embodiments and examples have been described and illustrated herein. The embodiments described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention can be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

What is claimed is:

1. A rolled product dispenser for dispensing a web of rolled product, the rolled product dispenser comprising:

a housing; and a dispensing assembly at least partially housed in the housing and interacting with the web of rolled product, the dispensing assembly comprising:

a dispensing roller having a rotation center and a peripheral wall with an upper section and a lower section;

an upper tensioning assembly including an upper tensioning member slidably mounted to the housing, the upper tensioning assembly urging the web of rolled product against the upper section of the peripheral wall of the dispensing roller when engaged with the dispensing assembly;

a lower tensioning assembly including a lower tensioning member mounted to the housing and urging the web of paper against the lower section of the dispensing roller; and at least one finger stripper connected to the upper tensioning assembly and the lower tensioning assembly and extending rearwardly of the peripheral wall of the dispensing roller, the at least one finger stripper defining a web path with the peripheral wall of the dispensing roller, the web of the rolled product at least partially contouring the upper tensioning member and the lower tensioning member and extending in the web path when engaged with the dispensing assembly.

2. The rolled product dispenser of claim 1, wherein the upper tensioning assembly is slidable along an upper tensioning path to provide a variable tension on the web of rolled product.

3. The rolled product dispenser of claim 2, wherein the lower tensioning assembly provides a variable tension on the web of rolled product.

4. The rolled product dispenser of claim 3, further comprising a variable tension return assembly comprising:

at least one eccentric attachment point spaced apart from the rotation center of the dispensing roller;

at least one anchor provided on the housing; and a dispensing roller biasing member extending along a path and connecting one of the at least one eccentric attachment point and one of the at least one anchor, the dispensing roller biasing member being configurable in at least two extension states by modifying at least one of the at least one eccentric attachment point, the at least one anchor, and the path of the dispensing roller biasing member.

5. The rolled product dispenser of claim 4, wherein the variable tension return assembly comprises at least one of a plurality of eccentric attachment points positioned at different distances from one of the at least one anchor and a plurality of anchors positioned at different distances from one of the at least one eccentric attachment point.

6. The rolled product dispenser of claim 4, wherein the variable tension return assembly further comprises at least one tension adjusting pin mounted to the housing and engageable with the dispensing roller biasing member between the at least one eccentric attachment point and the at least one anchor, each of the at least one tension adjusting pin being positioned to vary an angular position of the dispensing roller upon engagement with the dispensing roller biasing member.

7. The rolled product dispenser of claim 1, wherein the upper tensioning assembly and the lower tensioning assembly are configurable between a full tension configuration and a lower tension configuration, the upper tensioning assembly and the lower tensioning assembly being configured for the web of rolled product to cover more than about 60% of the peripheral wall of the dispensing roller when configured in the full tension configuration.

8. The rolled product dispenser of claim 7, wherein the upper tensioning assembly and the lower tensioning assembly are configured for the web of rolled product to cover between about 60% and about 75% of the peripheral wall of the dispensing roller when configured in the full tension configuration.

9. The rolled product dispenser of claim 1, wherein the housing comprises at least two spaced-apart supporting members supporting the dispensing roller on opposed ends thereof with each one of the supporting members comprising an upper groove defined therein and defining an upper tensioning path and wherein the upper tensioning member comprises an upper tensioning roller slidably engaged in an upper groove of each one of the supporting members and being slidable along the upper tensioning path.

10. The rolled product dispenser of claim 9, wherein the upper tensioning path defined by the upper grooves conforms to a section of the peripheral wall of the dispensing roller and is spaced apart therefrom.

11. The rolled product dispenser of claim 9, wherein the upper grooves have a lower and forward end and wherein the upper tensioning assembly further comprises a biasing member connected to the upper tensioning member and biases the upper tensioning member towards the lower and forward ends of the upper grooves.

12. The rolled product dispenser of claim 9, wherein the upper grooves have a lower and forward end and wherein the lower and upper tensioning assemblies further comprise a biasing member having a first end connected to the upper tensioning member and a second end connected to the lower tensioning member and biasing the upper tensioning member towards the lower ends of the upper grooves and the lower tensioning member towards the upper ends of the lower grooves.

13. The rolled product dispenser of claim 1, wherein the housing comprises at least two spaced-apart supporting members supporting the dispensing roller on opposed ends thereof with each one of the supporting members comprising a lower groove defined therein and defining a lower tensioning path and wherein the lower tensioning member comprises a lower tensioning roller slidably mounted in the lower grooves of the supporting members and being slidable along the lower tensioning path.

14. The rolled product dispenser of claim 13, wherein the lower grooves extend substantially tangentially to the peripheral wall of the dispensing roller.

15. The rolled product dispenser of claim 13, wherein the lower grooves have an upper end and wherein the lower tensioning assembly further comprises a biasing member connected to the lower tensioning member and biases the lower tensioning member towards the upper ends of the lower grooves.

16. The rolled product dispenser of claim 1, wherein the housing comprises at least two spaced-apart supporting members supporting the dispensing roller on opposed ends thereof with each one of the supporting members comprising an upper groove defined therein and defining an upper tensioning path and a lower groove defined therein and defining a lower tensioning path, and wherein the upper tensioning member comprises an upper tensioning roller slidably engaged in the upper grooves of the supporting members and being slidable along the upper tensioning path, and the lower tensioning member comprises a lower tensioning roller slidably engaged in the lower grooves of the supporting members and being slidable along the lower tensioning path.

17. The rolled product dispenser of claim 16, wherein the upper tensioning path defined by the upper grooves conforms to a section of the peripheral wall of the dispensing roller and is spaced apart therefrom.

18. The rolled product dispenser of claim 16, wherein the lower grooves extend substantially tangentially to the peripheral wall of the dispensing roller.

* * * * *